US009003991B1

(12) United States Patent
Hoover et al.

(10) Patent No.: US 9,003,991 B1
(45) Date of Patent: Apr. 14, 2015

(54) UNIVERSAL TROLLING MOTOR PEDAL

(71) Applicants: Darryl Hoover, Oklahoma City, OK (US); Mike Porter, Edmond, OK (US)

(72) Inventors: Darryl Hoover, Oklahoma City, OK (US); Mike Porter, Edmond, OK (US)

( * ) Notice: Subject to any disclaimer, the term of this patent is extended or adjusted under 35 U.S.C. 154(b) by 0 days.

(21) Appl. No.: 13/999,142

(22) Filed: Jan. 21, 2014

(51) Int. Cl.
*B63H 20/12* (2006.01)
*B63H 20/00* (2006.01)

(52) U.S. Cl.
CPC ..... *B63H 20/12* (2013.01); *B63H 20/007* (2013.01)

(58) Field of Classification Search
CPC ..... B63H 20/00; B63H 20/12; B63H 21/26; B63H 20/007; B63H 21/265; B63H 21/22
USPC ..... 114/153; 440/7
See application file for complete search history.

(56) References Cited

U.S. PATENT DOCUMENTS

| | | | |
|---|---|---|---|
| 231,017 | A | 8/1880 | Davis |
| 2,968,273 | A | 1/1961 | Corbett |
| 4,022,145 | A | 5/1977 | Tindal |
| 4,143,436 | A | 3/1979 | Jones |
| 4,386,918 | A | 6/1983 | Matthews |
| 4,515,567 | A | 5/1985 | Wilson |
| 4,569,663 | A | 2/1986 | Miller |
| 6,053,781 | A | 4/2000 | Littleton |
| 6,758,705 | B1 | 7/2004 | Bechtel |
| 8,221,175 | B2 | 7/2012 | Mynster |

*Primary Examiner* — Lars A Olson
(74) *Attorney, Agent, or Firm* — Randal Homburg

(57) ABSTRACT

A pedal control is applied to a trolling motor shaft to allow the driver of a boat to control the direction of the trolling motor from nearly any location within the boat to which the trolling motor is attached, the pedal control having a mechanical adjustable length extension rod between an adjustable height arm on the pedal and a bracket mounted to the trolling motor shaft with a universal joint applied at each end of the extension rod, allowing placement at a variety of distances and a variety of angles from the pedal on the floor of the boat to the trolling motor. A cut-off switch is optionally applied to the pivotal footplate on the pedal to turn the trolling motor on or off or remain at a constant speed.

7 Claims, 5 Drawing Sheets

UNIVERSAL TROLLING MOTOR PEDAL

CROSS REFERENCE TO RELATED APPLICATIONS

None.

I. BACKGROUND OF THE INVENTION

1. Field of Invention

A pedal control is applied to a trolling motor shaft to allow the driver of a boat to control the direction of the trolling motor from nearly any location within the boat to which the trolling motor is attached, the pedal control having a mechanical adjustable length extension rod between an adjustable height arm on the pedal and a bracket mounted to the trolling motor shaft with a universal joint applied at each end of the extension rod, allowing placement at a variety of distances and a variety of angles from the pedal on the floor of the boat to the trolling motor. A cut-off switch is optionally applied to the pivotal footplate on the pedal to turn the trolling motor on or off or remain at a constant speed.

2. Description of Prior Art

A preliminary review of prior art patents was conducted by the applicant which reveal prior art patents in a similar field or having similar use. However, the prior art inventions do not disclose the same or similar elements as the present pedal operated trolling motor steering apparatus, nor do they present the material components in a manner contemplated or anticipated in the prior art.

A pedal with a foot operated switch is disclosed in four prior art patents but are distinguishable from the present device. In Bechtel, U.S. Pat. No. 6,758,705, a foot pedal conversion kit is disclosed which provides the pedal attaching to a transom mount for the trolling motor with a retractable cable to steer the motor attached to a clamped on arm attaching to the motor shaft support. A electrical switch is shown on the pedal but there is no mention as to what that electrical switch is used for—whether an on/off switch or other. In Miller, U.S. Pat. No. 4,569,663, a fixed bent rod is supplied between the shaft mount and the pedal. Two adjustable features of the present device are not disclosed in Miller—the adjustable height of the upright pedal dual extension means to adjust the length of the spanner rod. In addition, the spanner rod connections of the present device, being universal for lateral positioning of the pedal within an array of potential location within the boat are not disclosed in Miller. It is a fixed position pedal. It contains an on/off switch in the pedal to turn the trolling motor on or off. In U.S. Pat. No. 4,515,567 to Wilson, the pedal is made part of the mounting transom and is installed in the immediate vicinity of the motor. There is no multiple positioning choices and no extension to move the pedal away from the transom. A bracket is attached to a motor shaft support on a trolling motor, the bracket further attaching a bar forming two outer pedals, at least one forming a switch bar with a heel clip and an on/off switch. This bar is moved by the right or left foot placed on the bar to turn the motor which the rider straddles the motor, using both feet in a seated position to steer the boat with the user's hands free.

II. SUMMARY OF THE INVENTION

Electric trolling motors are used in small boats to move the boat at a low speed and to steer the boat during fishing into small coves and other spots at a selected location on the water. These electric trolling motors are generally not used for primary propulsion. Fisherman who use these do so at low speeds to get into and out of hard to reach places and prefer to steer them without having to use their hands so that they can steer the boat, start and stop the motor movement, and still fish either standing or sitting at a location in the boat. As seen in the prior art, pedal used to steer a trolling boat are already part of the prior art, but the location within the boat at numerous locations is not possible. The present pivotal pedal can be applied to any electric trolling motor which is pivotally mounted to a boat regardless of the location of the motor in the boat—front, side or rear. It provides the pedal with a deadman switch connection integrated electrically between the battery and motor, an on/off switch, and a pedal connected to a motor shaft bracket by an extension rod having a universal ball joint connector on an adjustable height pedal upright member and another universal ball joint connector attached to the motor shaft bracket, the extension rod having at least one length adjustment means, providing the pivotal pedal with the ability to be positioned at several locations on the flat boat floor, easily moved from one location to another by the universal ball joint connections and the adjustable length extension rod.

III. DESCRIPTION OF THE DRAWINGS

The following drawings are submitted with this utility patent application.

IV. DESCRIPTION OF THE PREFERRED EMBODIMENT

Figure 1:
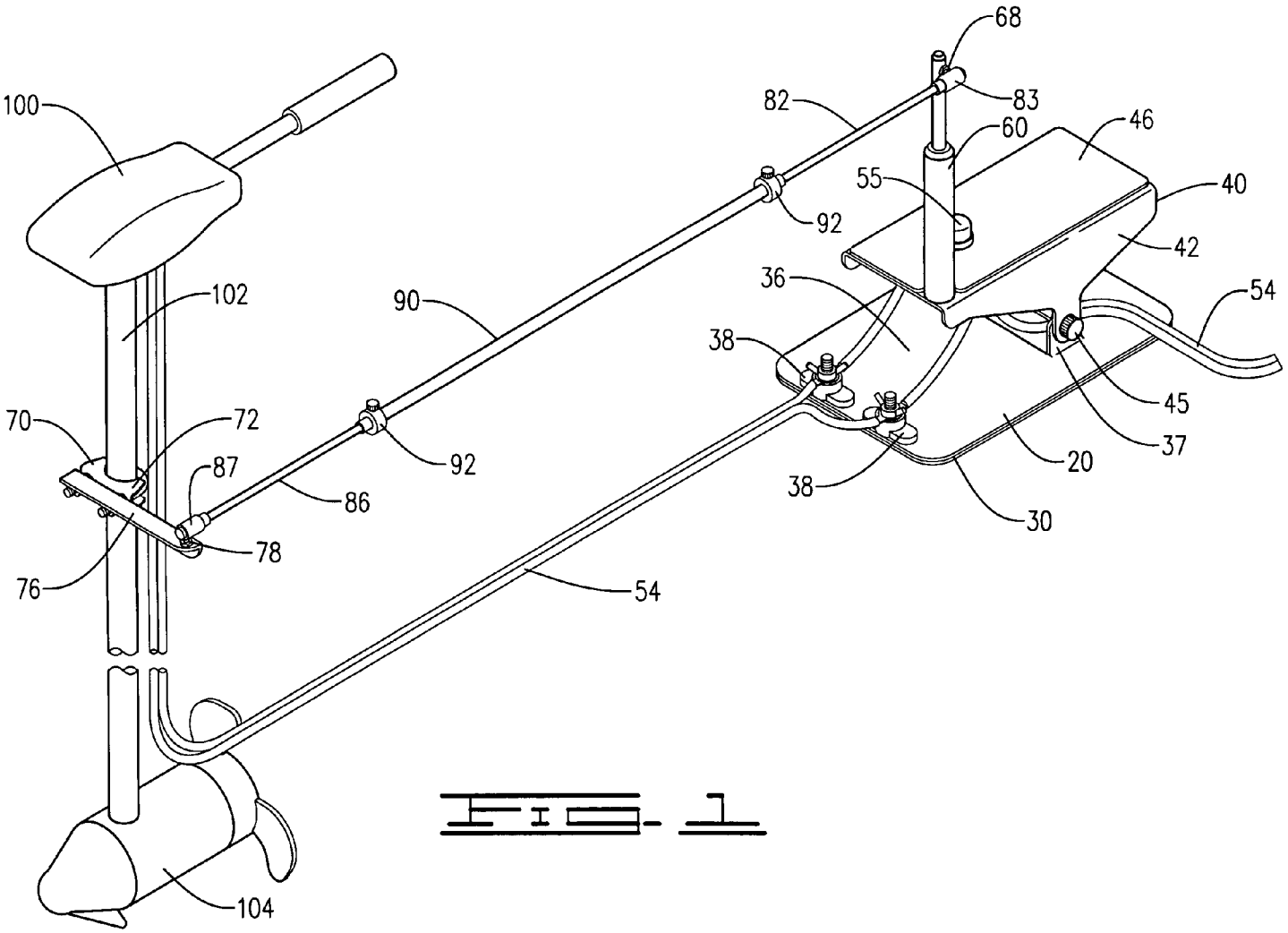
FIG. 1 is a upper perspective view of the universal trolling motor pedal control assembly.

A pedal assembly for application to a trolling motor 100 in a boat 200 providing remote steering and operation of the trolling motor 100 by foot from a variety of locations within the boat 200, shown in FIGS. 1-6 of the drawings, the pedal assembly comprising a pivotal pedal 20 defining a base member 30 and a pivotally engaged pedal member 40, a variable height vertical pedal extension 60 defining a first universal ball connector 68, an adjustable length extension rod 80 defining a first adjustable end 82 having a first universal ball socket 83 attaching the first universal ball connector 68, a central rod portion 90 and a second adjustable end 86 having a second universal ball socket 87, a trolling motor shaft connector 70 defining a shaft connector means 72 attached to a shaft 102 of the trolling motor 100 and a lateral extension arm 76 defining a second universal ball connector 78 attaching the second universal ball socket 87, electrical wiring 54 extending from a boat battery 210 to the trolling motor 10 including an on/off switch 50 located in the pedal member 40 and a dead man switch 55 located on an upper surface 44 of the pedal member 40, the on/off switch 50 providing a constant activation of the trolling motor 100 and the deadman switch 55 providing power to the trolling motor 100 upon depression only, wherein the pedal member 40 is pivoted by movement of an operator's foot, forcing the extension rod 80 forward or rearward, moving the lateral extension arm 76 forward or backward resulting in rotational movement of the shaft 102 of the trolling motor 100 to steer the trolling motor 100 and boat 200 in a right or left direction, allowing the trolling motor 100 to be operated by intentional motion of the foot for hands free steering.

Figure 4:
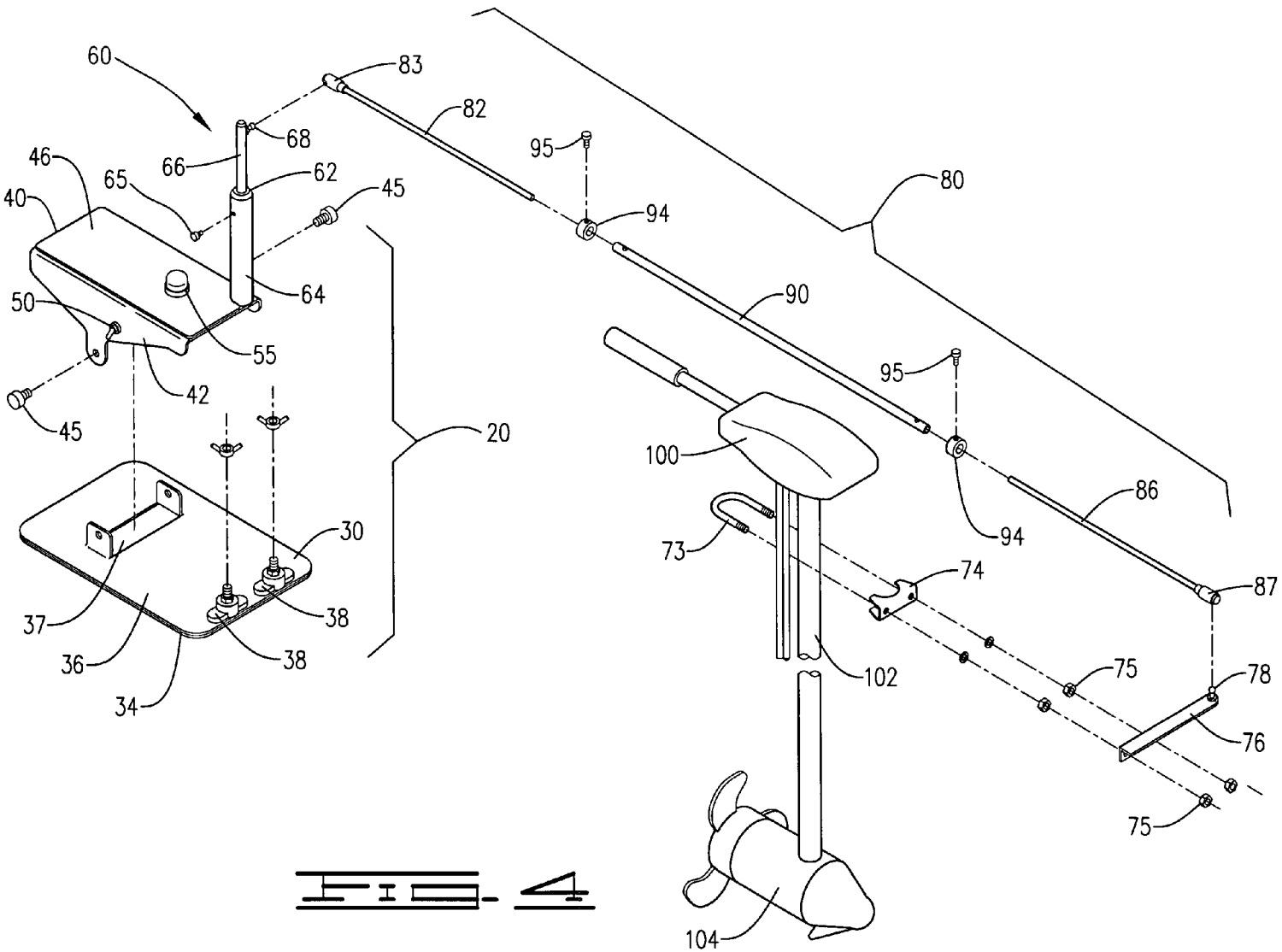
FIG. 4 is an exploded view of the universal pedal control assembly.
Figure 5:
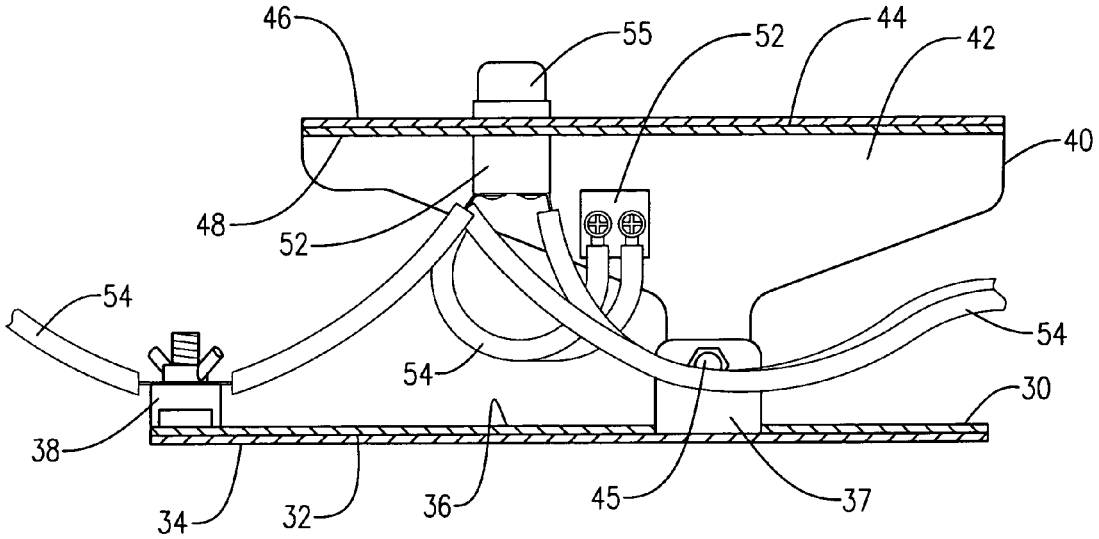
FIG. 5 is a sectional view of the universal pedal control along sectional lines 5/5 of FIG. 3.

The pedal 20 is more specifically disclosed as the base member 30 defining a lower surface 32 with a friction insulating pad 34 to prevent slippage of the pedal on the boat floor and also to provide some insulation between the floor 205 of the boat 200 and the pedal 20, FIG. 5. The base member 30 further defines an upper surface 36 having a pivot mounting bracket 37 and a pair of electrical connector posts 38, FIG. 4, which provide connection between to the boat battery 210 and the trolling motor 100. The pedal 20 further defines a pivotally attaching pedal member 40 having two lateral depending side extension sections 42 which attach to the pivot mounting bracket 37 by respective expanded screws 45, the on/off switch 50 attaching to one side extension 42, FIGS. 1, 2, and 4, an upper surface 44 attaching a non-slip surface pad 46, FIG. 5, and within which is mounted the deadman switch 54, and a lower surface 48 to which is attached electrical circuitry 52 for the deadman switch 54 and the on/off switch 50 attached by insulated electrical wiring 54 which connects to the boat battery 210, FIG. 5. The vertical pedal extension 60, FIGS. 1, 2 and 4, extends upward from the upper surface 44 and further defines at least one adjustable extension joint 62 defining a lower fixed pedestal 64 and an extending upper section 66 locking in place by an extension locking screw 65, the upper section 66 terminating in the first universal ball connector 68.

The extension rod 80, FIGS. 1-4, is adjusted to length by two locking collar joints 92, with each first and second adjustable end 82, 86, sliding within the central extension rod 90 with each respective first and second universal ball socket 83, 87, facing away from the central rod 90. Each collar joint 92 affixes a chosen length of each respective first and second adjustable end 82, 96, by use of a set screw 95 engaging a circular collar 94 within each respective collar joint 92, FIG. 1-4, each set screw 95 penetrating through each collar 94 and the central rod 90 into each adjustable end 92, 96, within the central rod 90.

Figure 3:
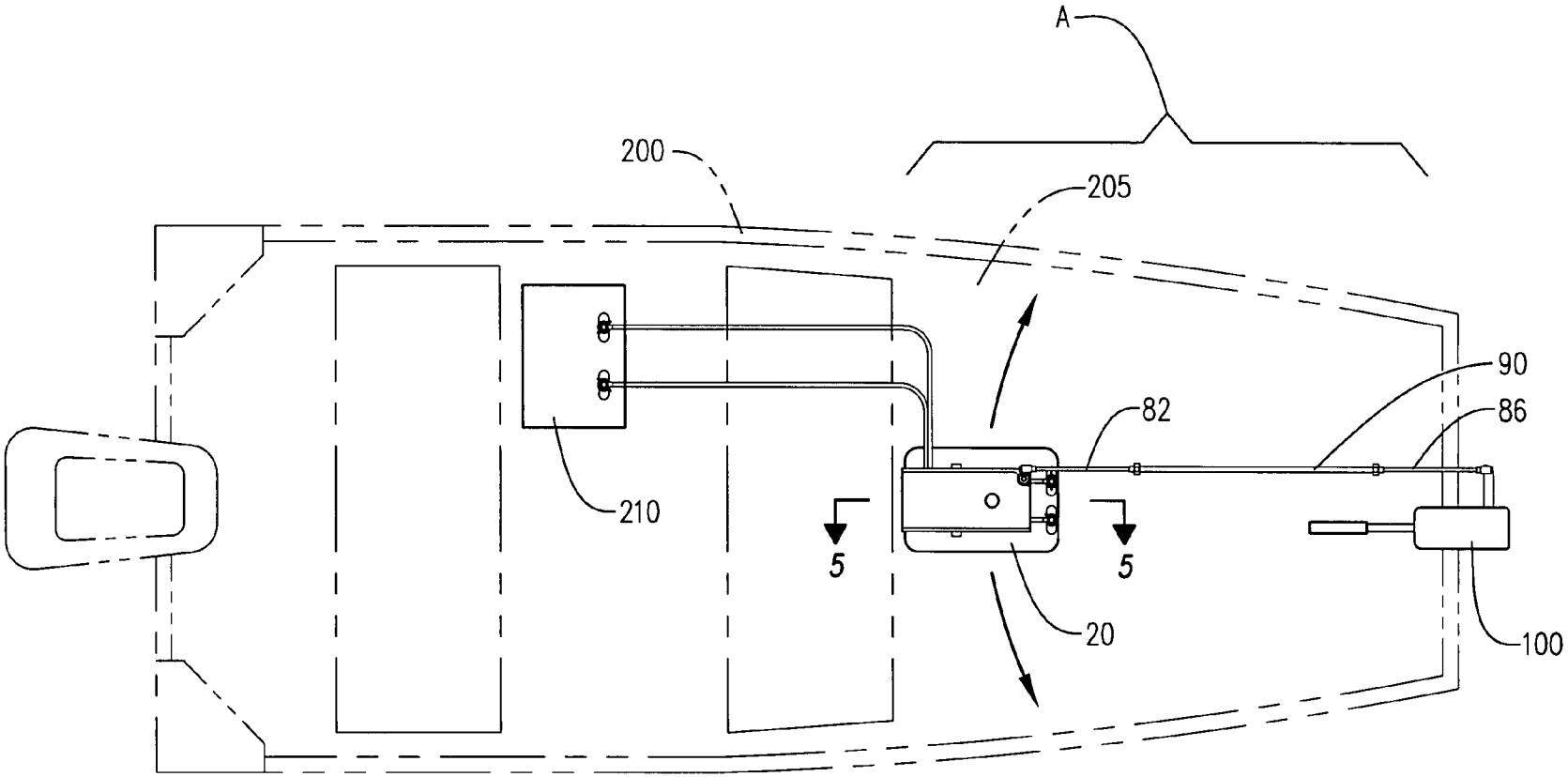
FIG. 3 is a top view of the universal trolling motor pedal in a boat indicating a positioning zone within the boat.
Figure 6:
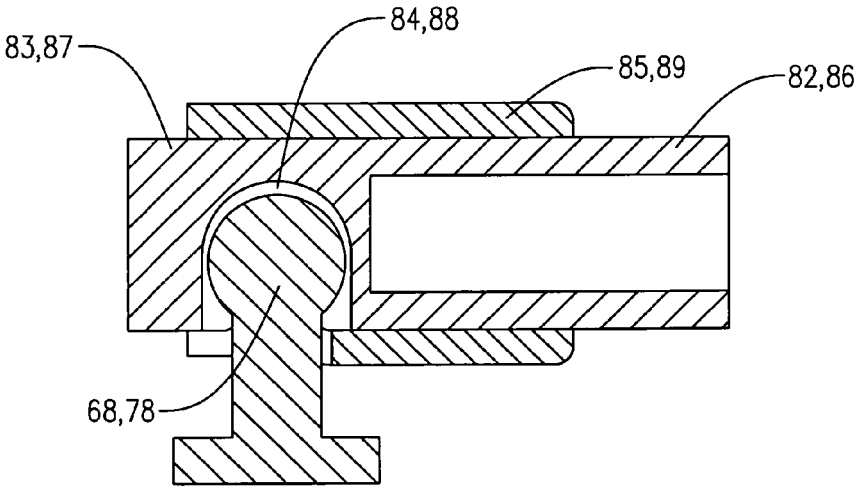
FIG. 6 is a sectional view of the universal ball connection along sectional lines 6/6 of FIG. 2.

Each universal ball connector 68, 78, and universal ball socket 93, 87, connection is as shown in FIG. 6, even though FIG. 6 is shown directed to the first adjustable end 82 and its connection to the vertical pedal extension 60. This connection allows for the connector/socket to be moved at many different angles and location within the floor 205 of the boat 200, as shown in FIG. 3 by the arrows, with the adjustable extension rod 80 allowing positioning of the pedal 20 at many different distances from the trolling motor 100, this area being defined as the boat placement zone A, FIG. 3. As shown, the pedal operator may sit or stand at any location within that placement zone A to fish, hands free, while operating the trolling motor 100, as opposed to the prior art pedals which require the stationary placement of the pedal and do not provide a comparable variety of locations where the pedals may be positioned for operation. Alternatively, the pedal 20 may be anchored to the boat floor 205 by an attaching means for permanent installation by screws, adhesive or other physical means and in such case, be mounted with or without the friction insulation pad 38, not shown, but installed at any selected location within the placement zone A.

Figure 2:
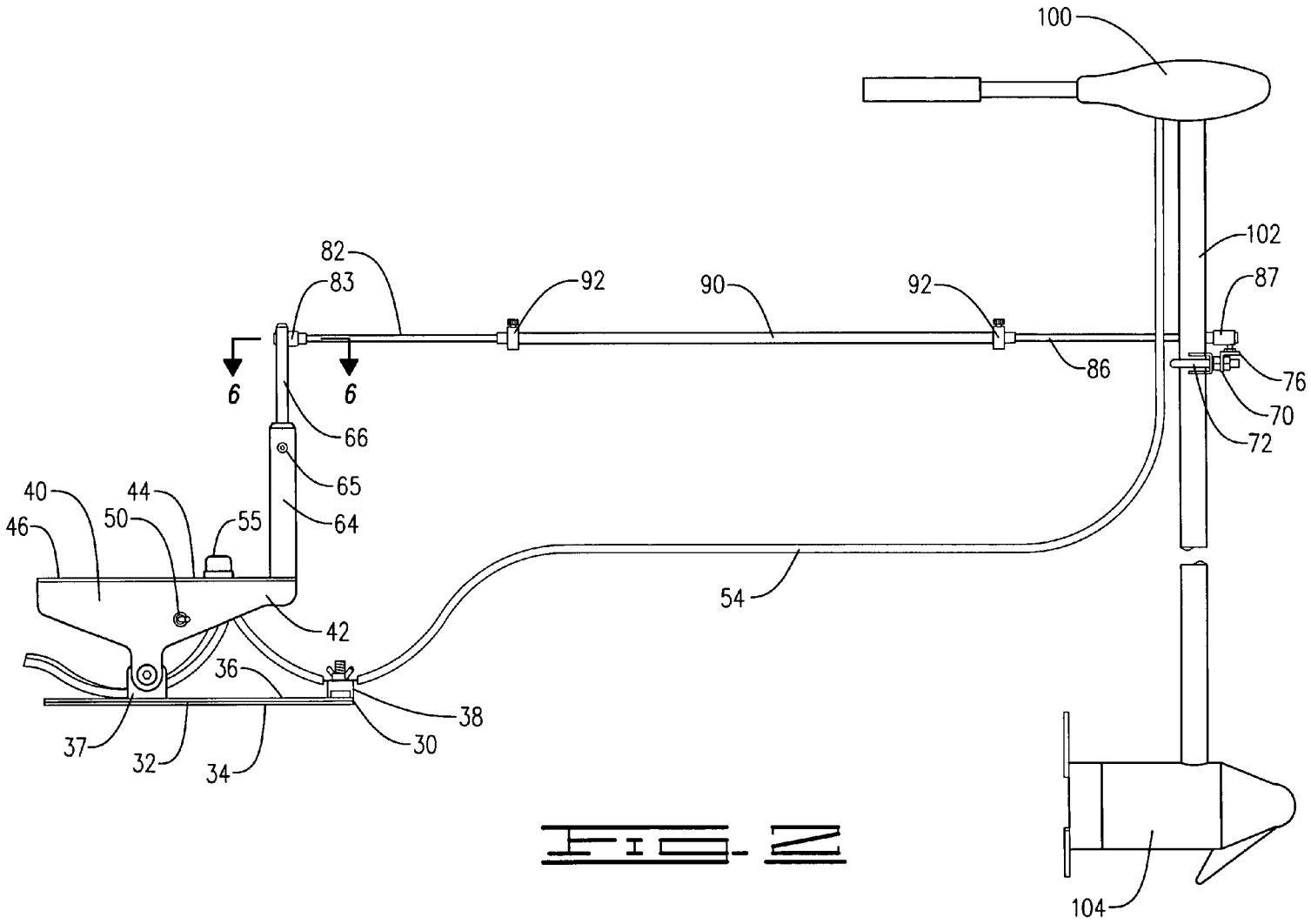
FIG. 2 is a side view of the universal trolling motor pedal control assembly.

The trolling motor shaft connector 70 further defines the shaft connecting means 72 as a U-bolt 73 with a rear bracket 74 attaching together by nuts 75 and securing to the trolling motor shaft 102 at a chosen location between the motor 100 and the lower propeller shaft 104, as shown in FIGS. 1, 2 and 4. Attaching also to the U-bolt 73 is the lateral extension arm 76 defining the second universal ball connector 78. The lateral extension arm 76 may be placed either to the right or left of the trolling motor shaft 104, the lateral extension arm 76 being ambidextrous. The lateral extension arm 76 should be perpendicular to the direction of the propulsion of the trolling motor 100 and more so, should be in this position when the pedal member 40 is level with the base member 30, FIG. 2.

Installation of the pedal assembly within the boat 200 is a very simple procedure. The pedal 20 is placed upon the boat floor 205 within the placement zone A. The shaft connector 70 is applied to the trolling motor shaft 102 with the lateral extension arm 76 perpendicular to the propeller shaft 104. The extension rod 80 is adjusted to length with each first and second universal ball connector 68, 78, attaching to each respective first and second universal ball socket 83, 87, after which each adjustable end 82, 86, is locked into place at each collar joint 92. The wiring 54 from the pedal 20 is connected to the boat battery 210 and the electrical wiring 54 from the trolling motor 100 is connected to the pair of electrical connector posts 38. The on/off switch 50 may be turned on to provide a constant propulsion to the trolling motor 100, or the deadman switch 54 can be compressed by the operator to operate the trolling motor 100 with the pedal member 40 being manipulated to steer the trolling motor 100 in the direction intended by the operator.

While the pedal assembly, including the pedal 20, extension rod 80 and shaft connector 70, has been particularly shown and described with reference to a preferred embodiment thereof, it will be understood by those skilled in the art that changes in form and detail may be made therein without departing from the spirit and scope of the invention.

What is claimed is:

1. A pedal assembly for application to a trolling motor in a boat providing remote steering and operation of said trolling motor by foot movement of a boat operator from a variety of locations within said boat, said pedal assembly comprising:

a pivotal pedal defining a base member and a pivotally engaged pedal member;

a variable height vertical pedal extension defining a first universal ball connector;

an adjustable length extension rod defining a first adjustable end having a first universal ball socket attaching said first universal ball connector, a central rod portion and a second adjustable end defining a second universal ball socket; and a trolling motor shaft connector defining a shaft connector means attached to a vertical shaft of said trolling motor and a lateral extension arm defining a second universal ball connector attaching said second universal ball socket, electrical wiring extending from a boat battery to said pivotal pedal and electrical wiring extending from said pivotal pedal to said trolling motor, said pivotal pedal supplying an on/off switch located in said pedal member and a dead man switch located on an upper surface of said pedal member, said on/off switch connecting to said electrical wiring and providing a constant activation of said trolling motor and said dead man switch providing power to said trolling motor upon depression only, wherein said pedal member is pivoted by movement of an operator's foot, forcing said extension rod forward or rearward, moving said lateral extension arm forward or backward resulting in rotational movement of said vertical shaft of said trolling motor to steer said trolling motor and boat in a right or left direction, directing said movement and direction of said trolling motor by intentional motion of said operator's foot for hands free steering.

2. The pedal assembly as disclosed in claim 1, said pivotal pedal further comprising:

said base member defining a lower surface with a friction insulating pad preventing slippage of said pedal on said boat floor and also to provide insulation between said floor of said boat and said pivotal pedal, said base member further defining an upper surface having a pivot mounting bracket and a pair of electrical connector posts providing intermediate connection between said boat battery and said trolling motor; and a pivotally attaching pedal member extending two parallel lateral depending side extension sections which attach to said pivot mounting bracket by respective expanded screws, said on/off switch attaching to one side extension, an upper surface attaching a non-slip surface pad within which is mounted said deadman switch and a lower surface to which is attached electrical circuitry for said dead man switch and said on/off switch attached by insulated electrical wiring connecting to said boat battery.

3. The pedal assembly as disclosed in claim 1, said vertical pedal extension extending upward from an upper surface of said pivotal pedal and further comprising at least one adjustable extension joint defining a lower fixed pedestal and an extending upper section locking in place by an extension locking screw, said upper section terminating in said first universal ball connector.

4. The pedal assembly as disclosed in claim 1, wherein said extension rod is adjusted to length by two locking collar joints, with each first and second adjustable end, sliding within said central extension rod and with each respective first and second universal ball socket facing away from said central rod, each said collar joint affixing a selected length of each respective first and second adjustable end by use of a set screw engaging a circular collar within each respective collar joint, each set screw penetrating through each collar and said central rod into each said respective adjustable end within said central rod.

5. The pedal assembly as disclosed in claim 1, each universal ball connector and universal ball socket providing movement at different angles and locations within said floor of said boat, with said adjustable extension rod allowing positioning of said pivotal pedal at various different distances from said trolling motor.

6. The pedal assembly as disclosed in claim 1, said trolling motor shaft connector further comprising:

said shaft connecting means is a U-bolt with an attaching rear bracket securing together by nuts tightening together and securing to said trolling motor shaft at a chosen location along said vertical shaft of said trolling motor above a lower propeller shaft, said lateral extension arm attaching between said rear bracket and said nuts, said lateral extension arm optionally placed either to the right or left of said trolling motor shaft and perpendicular to a direction of propulsion of said trolling motor when said pivotal pedal member is level with said base member.

7. The pedal assembly as disclosed in claim 1, further comprising:

said vertical pedal extension extending upward from an upper surface of said pivotal pedal and further comprising at least one adjustable extension joint defining a lower fixed pedestal and an extending upper section locking in place by an extension locking screw, said upper section terminating in said first universal ball connector;

said extension rod adjusted to length by two locking collar joints, with each first and second adjustable end, sliding within said central extension rod and with each respective first and second universal ball socket facing away from said central rod, each said collar joint affixing a selected length of each respective first and second adjustable end by use of a set screw engaging a circular collar within each respective collar joint, each set screw penetrating through each collar and said central rod into each said respective adjustable end within said central rod;

each universal ball connector and universal ball socket providing movement at different angles and locations within said floor of said boat, with said adjustable extension rod allowing positioning of said pivotal pedal at various different distances from said trolling motor; and said shaft connecting means is a U-bolt with an attaching rear bracket securing together by nuts tightening together and securing to said trolling motor shaft at a chosen location along said vertical shaft of said trolling motor above a lower propeller shaft, said lateral extension arm attaching between said drear bracket and said nuts, said lateral extension arm optionally placed either to the right or left of said trolling motor shaft and perpendicular to a direction of propulsion of said trolling motor when said pivotal pedal member is level with said base member.

* * * * *